US005585778A

United States Patent [19]

Bräuer et al.

[11] Patent Number: 5,585,778

[45] Date of Patent: Dec. 17, 1996

[54] DEVICE FOR DETECTING NET FAULTS IN TENNIS

[76] Inventors: Dietmar Bräuer; Dieter Naber, both of Am Sachsenwäldle 32, D-78050 Villingen-Schwenningen, Germany

[21] Appl. No.: 277,896

[22] Filed: Jul. 20, 1994

[30] Foreign Application Priority Data

Jul. 27, 1993 [DE] Germany ..... 9311170 U

[51] Int. Cl.[6] ..... G08B 5/00

[52] U.S. Cl. ..... 340/323 R; 273/29 R; 273/29 B

[58] Field of Search ..... 340/323 R; 273/29 R, 273/29 B

[56] References Cited

U.S. PATENT DOCUMENTS

| | | | |
|---|---|---|---|
| 3,415,517 | 12/1968 | Krist | 273/31 |
| 4,398,724 | 8/1983 | Wilson et al. | 273/411 |
| 4,644,376 | 5/1987 | Gray | 340/323 R |
| 4,814,986 | 3/1989 | Spielman | 340/323 R |
| 4,840,377 | 6/1989 | Bowser et al. | 340/323 R |
| 4,894,528 | 1/1990 | Diaconu et al. | 250/222.1 |
| 5,243,327 | 9/1993 | Bentz et al. | 340/566 |

FOREIGN PATENT DOCUMENTS

| | | |
|---|---|---|
| 3843266 | 6/1990 | Germany . |
| 4210642A1 | 10/1993 | Germany . |
| 2070942 | 9/1981 | United Kingdom . |

OTHER PUBLICATIONS

Translated Abstract of DE 3843266.

*Primary Examiner*—Jeffery Hofsass
*Assistant Examiner*—Daniel J. Wu
*Attorney, Agent, or Firm*—Collard & Roe, P.C.

[57] ABSTRACT

A device for for detecting net faults in tennis including a sensor mounted near or on the net or its anchoring components. The sensor is an accelerometer or a piezoelectric transducer that generates an electrical signal. The signal is processed and drives an audio output device or an optical output device.

3 Claims, 1 Drawing Sheet

DEVICE FOR DETECTING NET FAULTS IN TENNIS

BACKGROUND OF THE INVENTION

1. Field of the Invention

The present invention relates to a device for detecting net faults in tennis.

2. Prior Art

According to the playing rules of tennis, a fault is assessed when a served ball touches the net prior to impact with the opponent's court. In cases of doubt, such a fault is not always recognized because the vibrations of the net caused by the contact with the ball can no longer be detected.

DE-A-38 43 266 describes an indicator device for tennis, which consists of at least one electronic sensor installed within the top edge of the net. The sensor responds to the mechanical vibrations occurring therein due to contact of the edge with the playing ball. The sensor is arranged in an electric circuit containing an optical or audio signal emitter, and, in case of response, triggers the signal emission. A piezo glass-breaking indicator is specified as the sensor.

However, the glass-breaking indicator, is not suitable in the present case because it responds to only one frequency, that of breaking glass.

SUMMARY OF THE INVENTION

It is therefore an object of the invention to overcome the drawbacks of the prior art and to provide a device for accurately detecting net faults.

These and other related objects are achieved according to the invention by a device which includes a sensor, for example, a motion sensor, an accelerometer or a piezoelectric transducer. The sensor may be located between the posts where the net is suspended or may be mounted directly on the net. Alternatively, the sensor may be mounted on any of the anchoring components of the net where it can detect the vibrations caused by the ball contacting the net. The vibrations trigger the sensor which generates an electric signal or electric pulse that is analyzed by a signal processor. The signal then activates an audio or optic output device.

With the device according to the invention, an important advantage is realized in that fault assessment can be safely and objectively determined as opposed to the subjective assessment by the linesman or umpire. Even the slightest vibrations caused by the ball contacting the net are detected. An accelerometer or piezoelectric transducer is particularly suited to detecting these types of vibrations.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
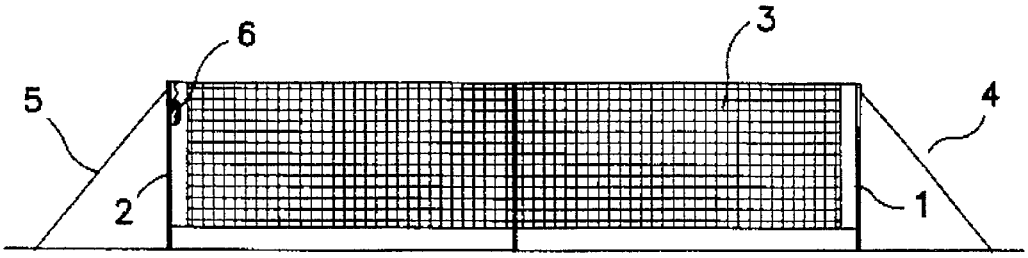
FIG. 1 is an elevational view of a net suspended across a tennis court equipped with the device according to the invention.

Turning now in detail to the drawings, FIG. 1 shows a net 3 suspended between two net posts 1, 2 and fastened by means of two tie-downs 4, 5. An electric, electromechanical or electronic sensor 6 is mounted on post 2 directly beneath the net. Sensor 6, which responds to vibrations of the net caused by contact with the ball, is for example, an accelerometer, or a piezoelectric transducer.

Figure 2:
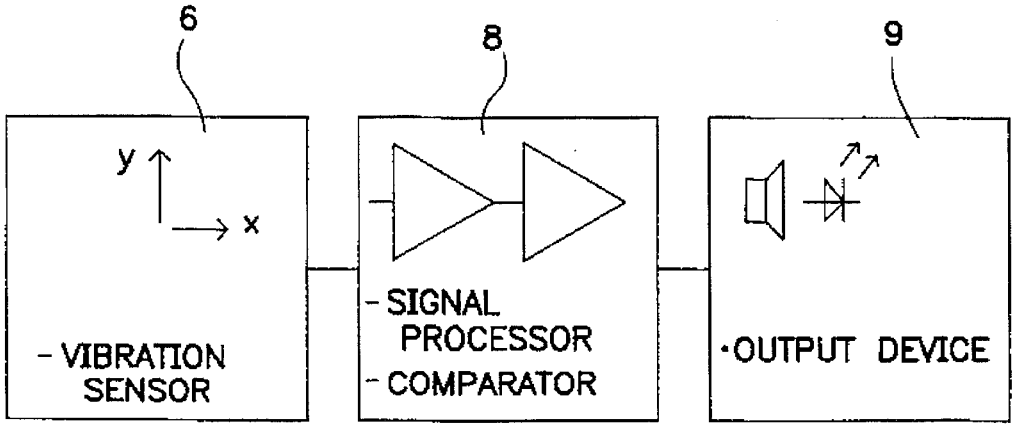
FIG. 2 is a block diagram of a circuit for processing the electric pulses or signals.

FIG. 2 shows sensor 6 connected to an electronic signal processor or comparator 8, which in turn is connected to an electric output device 9. Output device 9 is an audio and/or optical output device.

In the example shown in FIG. 1, sensor 6 is capable of detecting the mechanical vibrations caused by the ball contacting the net contactless via the air vibrations of the suspended net and/or its tie-downs 4, 5.

If an accelerometer is used, the mechanical vibrations caused by the ball-net contact can be detected by the sensor directly via one or several fastening elements of the net.

While one embodiment of the present invention has been shown and described, it is to be understood that many changes and modifications may be made thereunto without departing from the spirit and scope of the invention as defined in the appended claims.

What is claimed is:

1. A device for detecting a fault when a tennis ball contacts a tennis net supported by a post comprising:

at least one sensor mounted adjacent the net for generating an electrical signal in response to mechanical vibrations and stresses on the net caused by the ball contacting the net, one of said sensors being mounted on the post, wherein said at least one sensor is selected from the group consisting of an electric sensor, an electromechanical sensor, and an electronic sensor and said at least one sensor is further from the group consisting of an accelerometer and a piezoelectric transducer;

an output device selected from the group consisting of an audio output device and an optical output device; and electronic signal processing means comprising a comparator connected between said at least one sensor and said output device in a linear circuit arrangement for activating said output device in response to the electrical signal.

2. A device for detecting a fault according to claim 1, wherein one of said sensors is mounted on the net.

3. A device for detecting a fault according to claim 1, wherein one of said sensors is mounted on a cable suspending the net.

* * * * *